US009700903B2

(12) United States Patent
Kawamori et al.

(10) Patent No.: US 9,700,903 B2
(45) Date of Patent: Jul. 11, 2017

(54) STRAIGHTENING DEVICE AND FLUID NOZZLE

(71) Applicant: SUGINO MACHINE LIMITED, Uozu, Toyama Prefecture (JP)

(72) Inventors: Yoshiteru Kawamori, Uozu (JP); Toyoaki Mitsue, Toyama (JP); Tomio Sawasaki, Uozu (JP)

(73) Assignee: SUGINO MACHINE LIMITED, Uozu (JP)

( * ) Notice: Subject to any disclaimer, the term of this patent is extended or adjusted under 35 U.S.C. 154(b) by 0 days.

(21) Appl. No.: 14/794,234

(22) Filed: Jul. 8, 2015

(65) Prior Publication Data

US 2016/0067721 A1 Mar. 10, 2016

(30) Foreign Application Priority Data

Sep. 8, 2014 (JP) ..... 2014-181919

(51) Int. Cl.

| | |
|---|---|
| ***B05B 1/00*** | (2006.01) |
| ***B05B 1/34*** | (2006.01) |
| ***B05B 1/06*** | (2006.01) |
| ***B05B 1/02*** | (2006.01) |

(52) U.S. Cl.

CPC ..... *B05B 1/34* (2013.01); *B05B 1/02* (2013.01); *B05B 1/06* (2013.01)

(58) Field of Classification Search

CPC ..... B05B 1/34; B05B 1/02; B05B 1/06
USPC ..... 239/589, 590, 601
See application file for complete search history.

(56) References Cited

U.S. PATENT DOCUMENTS

| | | | | |
|---|---|---|---|---|
| 2,731,299 A * | 1/1956 | Bramming | ..... | F23D 11/44 137/513.5 |
| 6,332,581 B1 | 12/2001 | Chin et al. | | |
| 6,851,632 B2 * | 2/2005 | Ferrazza | ..... | B05B 1/34 222/575 |
| 2001/0040191 A1 * | 11/2001 | Purvis II | ..... | B05B 1/042 239/337 |

FOREIGN PATENT DOCUMENTS

| | | |
|---|---|---|
| GB | 2 306 795 A | 5/1997 |
| JP | H03-34848 U | 4/1991 |
| JP | 4321862 B2 | 8/2009 |

OTHER PUBLICATIONS

Jan. 22, 2016 Office Action issued in European Patent Application No. 15184050.1.

* cited by examiner

*Primary Examiner* — Jason Boeckmann
(74) *Attorney, Agent, or Firm* — Oliff PLC

(57) ABSTRACT

To provide a straightening device that is large in effective sectional area and has high straightening performance. This is a straightening device arranged in a fluid passage for making fluid pass through it that is provided with: a main body having an inflow port arranged in the fluid passage and for flowing the fluid into it, an outflow port for flowing the fluid out of it, and a communication passage for communicating the inflow port with the outflow port; and multiple projections that are arranged in a protruding manner toward a central part of the communication passage from an inner peripheral part and extend along the communication passage, in which the projections are each configured to have a narrower width in the central part than that in an inner peripheral part of the communication passage when seen from a flow direction of the fluid.

3 Claims, 11 Drawing Sheets

STRAIGHTENING DEVICE AND FLUID NOZZLE

BACKGROUND

1. Field of the Invention

The present invention relates to a straightening device and a fluid nozzle.

2. Description of the Related Art

A jet flow of high-pressure liquid spouted from a jet nozzle is utilized, for example, for deburring of a machine part, or washing, descaling, and exfoliation of concrete, etc. Especially, there is utilized a moving device having a three-dimensional degree of freedom to which a nozzle is arranged and that removes burr around machined surfaces of a machine part such as automobile parts and washes out cut chips (scraps) filled in screw holes of the machine part. The high-pressure liquid is mainly obtained by a plunger pump.

An effect of processing of performing the deburring, the washing, and the descaling by the jet flow of the high-pressure liquid is largely affected by dynamic pressure density that the high-pressure liquid has, convergence of the jet flow, and straightening and a flow rate of the high-pressure jet flow. There is a case where the straightening device is attached to an inlet port of the jet nozzle in order to hold the dynamic pressure density and the convergence of the high-pressure liquid high (for example, refer to Japanese Patent No. 4321862 and Japanese Unexamined Utility Model Application Publication No. H3-34848).

A straightening device (cavitation stabilizer) described in Japanese Patent No. 4321862 has a tubular straight passage that is arranged on its entrance side and a penetration passage that is arranged on its exist side for sending the jet flow from this tubular straight passage into the jet nozzle after dividing it into multiple parallel splits. A straightening device of Japanese Unexamined Utility Model Application Publication No. H3-34848 includes a support frame part of a cylindrical shape and multiple tabular straightening plates supported by this support frame part.

However, in the case of utilizing the straightening device according to Japanese Patent No. 4321862, since an effective sectional area of the straightening device became small by a penetration passage, there was a problem that it was hard to apply this straightening device to a straightening device for straightening a jet flow of a large flow rate.

Moreover, in the straightening device according to Japanese Unexamined Utility Model Application Publication No. H3-34848, since a support frame part was toric and a connection portion between the support frame part and a straightening plate was small, there was a problem that it was rather difficult to achieve a sufficient straightening effect because of a shortage of support rigidity of the support frame part and the straightening plate when applying it to high-pressure fluid.

An object of the present invention is to provide a straightening device whose effective sectional area is large and that has a high capability of straightness.

SUMMARY

In view of the above-mentioned problem, the straightening device of the present invention is a straightening device that is arranged in a fluid passage for allowing fluid to pass, is provided with a main body arranged in the fluid passage and having an inflow port for flowing the fluid into it, an outflow port for flowing out the fluid, and a communication passage for communicating the inflow port with the outflow port, and multiple projections that are arranged in a protruding manner from the inner peripheral part of the communication passage to a central part and extend along the communication passage, and the projection being formed so that a width of the central part may be narrower than that of the inner peripheral part of the communication passage when seen from a flow direction of the fluid. According to such a configuration, since the projection is arranged projecting toward a central part of the communication passage from the inner peripheral part, a sectional area of the communication passage can be secured widely, and thereby the effective sectional area of the straightening device becomes larger. For this reason, even when the fluid of the large flow rate passes through this straightening device, pressure drop is small. Moreover, since the projection is formed so that the width of the central part may be narrower than that of the inner peripheral part of the communication passage when seen from the flow direction of the fluid, it is possible to uniformize a flow velocity of the fluid in a radial direction and to improve rigidity of the main body and the projection. For this reason, when circulating the high-pressure fluid, the straightening device can bear the impact force by plunge or interception of the high-pressure fluid.

Desirably, the straightening device of the present invention is such that an outer peripheral part of the main body is inserted and fitted into the fluid passage. According to this configuration, since the outer peripheral part of the main body is included in the fluid passage with exact assembly precision, rigidity is secured, multiple projections arranged in the main body can be disposed in the fluid passage with precision and being stabilized. Then, even under a severe operating condition, an excellent straightening effect can be obtained conjointly with the high rigidity that the straightening device itself has.

In the straightening device of the present invention, desirably, the projection is formed to be a V shape whose width becomes narrower gradually toward the central part from the inner peripheral part of the communication passage when seen from the flow direction of the fluid. Here, the V shape is used to mean a shape such that a cross-sectional width of the projection is wide on the inner peripheral part side of the communication passage and becomes narrower gradually on a tip side of the projection of the central part, and it doesn't matter whether a shape of the tip part is an acute shape, a trapezoidal shape, or rounded. Since the projection is formed to be the V shape, an amount of variation of the cross-sectional length in a circumferential direction of the communication passage with respect to the radial direction is small. For this reason, a flow velocity in the straightening device in the radial direction becomes uniform. Moreover, internal stress that is generated by a pressure of the fluid flowing inside the straightening device and acts on the projection becomes small, and the strength of the projection is improved.

In the straightening device of the present invention, desirably, the projection is arranged on the inflow port side to the communication passage and the main body includes a cylindrical part with no projection arranged thereon on its outflow port side.

According to this configuration, due to the arrangement that the straightening device is provided with the cylindrical part in which the projection is arranged on the inflow port side and the projection is not arranged on the outflow port side, the pressure of the fluid circulating the communication passage is temporarily released when the fluid moves from the inflow port side where the projections are arranged to the cylindrical part; accordingly the flow velocity on the circumference (circumferential direction) in the communication passage when seen from the flow direction can be uniformized and therefore the straightening effect can be improved more.

The straightening device of the present invention is provided with a restriction arranged in a fluid passage and a spouting port arranged in this restriction and it is desirable that the straightening device be applied to a fluid nozzle such that fluid flowed from the outflow port of the straightening device is spouted from the spouting port through the restriction. By introducing the fluid whose flow velocity is uniformized by the straightening device of the present invention into the restriction arranged in the fluid passage, turbulence of the jet flow that spouted from the spouting port can be suppressed; thereby its straightness can be improved.

The straightening device according to the present invention has high durability, is large in effective sectional area, and has high straightening performance. The fluid nozzle according to the present invention can suppress turbulence of the jet flow that spouted from the spouting port, and can improve the straightness.

BRIEF DESCRIPTION OF THE DRAWINGS

Non-limiting and non-exhaustive embodiments of the present embodiments are described with reference to the following FIGURES, wherein like reference signs refer to like parts throughout the various views unless otherwise specified.

FIG. 1A and FIG. 1B are perspective views showing a first embodiment of a straightening device of the present invention, in which FIG. 1A shows a perspective view seen from the upstream side and FIG. 1B shows a perspective view seen from the downstream side.

FIG. 2A and FIG. 2B show the straightening device of the first embodiment of the present invention, in which FIG. 2A is a longitudinal sectional view and FIG. 2B is a right side view.

FIG. 10A and FIG. 10B show a fluid nozzle provided with a straightening device of a second embodiment of the present invention, in which FIG. 10A is a longitudinal sectional view and FIG. 10B is a right side view.

FIG. 11A and FIG. 11B show a fluid nozzle provided with the straightening device of the second embodiment of the present invention, in which FIG. 11A shows a perspective view seen from the upstream side and FIG. 11B is shows a perspective view seen from the downstream side.

DETAILED DESCRIPTION

First Embodiment

Figure 1B:
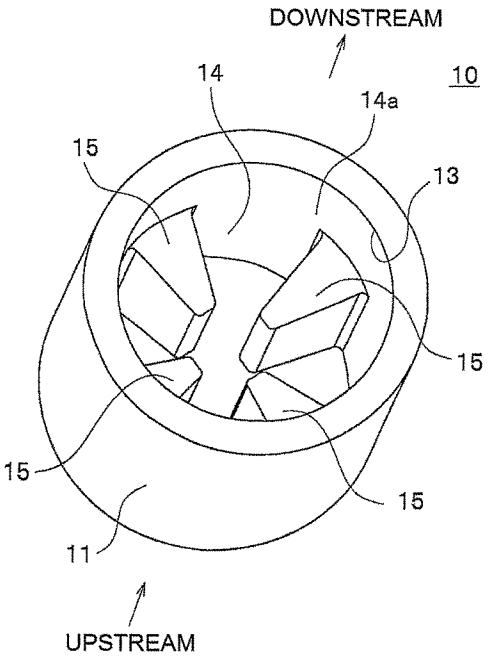
Figure 1A:
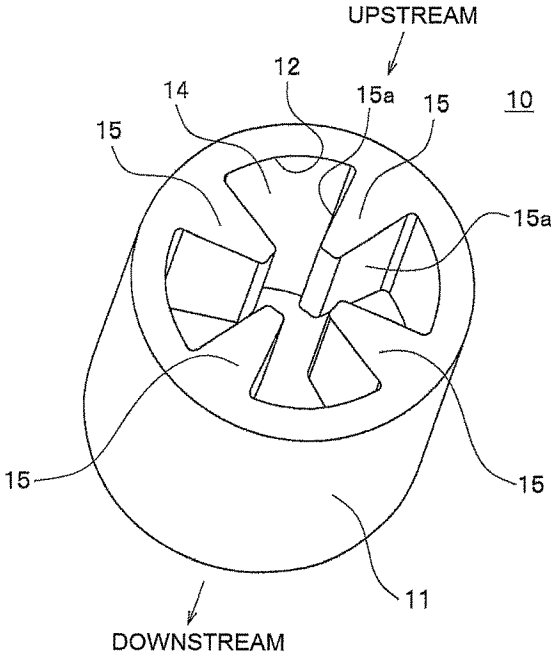
Figure 2B:
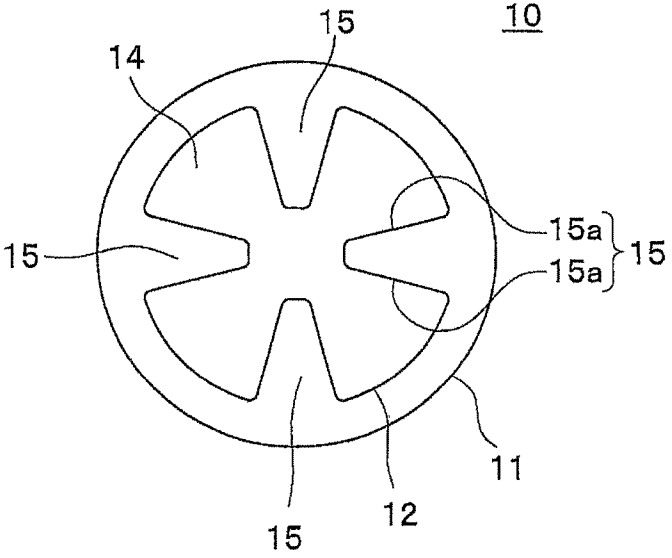
Figure 2A:
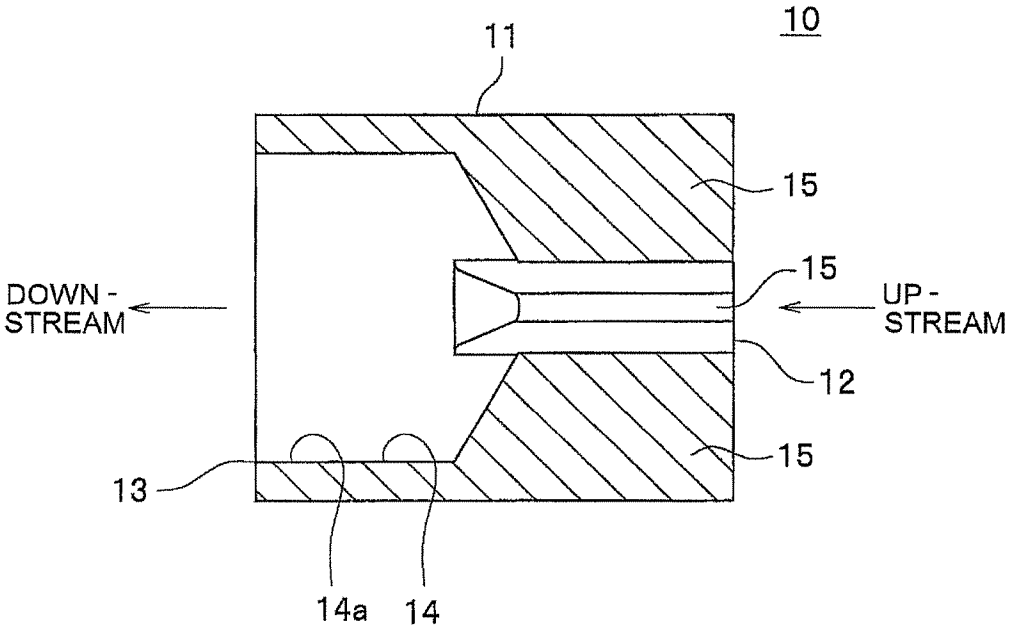
Figure 3:
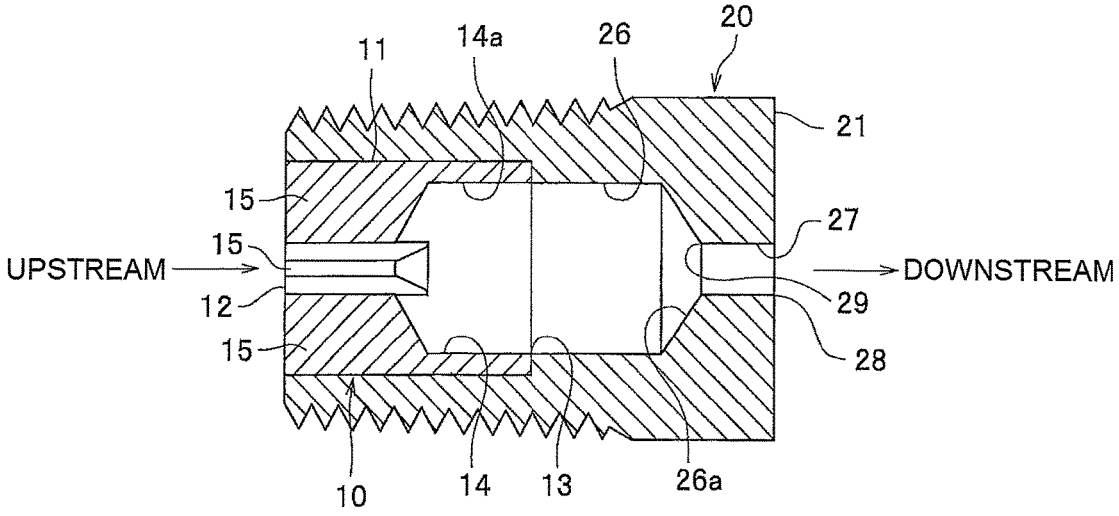
FIG. 3 shows a longitudinal sectional view of a fluid nozzle assembly body to which the straightening device of the first embodiment of the present invention is incorporated.

A straightening device 10 of a first embodiment of the present invention will be described according to FIG. 1A, FIG. 1B, FIG. 2A, FIG. 2B, and FIG. 3. The straightening device 10 is provided with, as shown in FIG. 1A and FIG. 1B a frame body-like main body 11, a communication passage 14 that is a cavity inside the frame body, an inflow port 12 and an outflow port 13 that are apertures at both ends of the communication passage 14, and projections 15 arranged extending along the communication passage 14 from an inner peripheral surface thereof. The straightening device 10 is arranged in a fluid passage 26 of a fluid nozzle 20, as shown in FIG. 3. Fluid is introduced into the inflow port 12 from an unillustrated feed flow channel so as to flow from the outflow port 13 to the fluid passage 26 of the fluid nozzle 20 through the communication passage 14.

The frame body-like main body 11 is a hollow cylinder as shown in FIG. 1A and FIG. 1B. The main body 11 has a large cavity that opens at both ends thereof. An external surface of the main body 11 may be a polygon pillar such as a hexagon pillar instead of the cylindrical surface, or may be comprised of a part of the cylindrical surface and a plane surface. The main body 11 is manufactured so that its length may have a ratio of about 40 to 120% to a diameter of the main body 11. The main body 11 is arranged with its outer peripheral surface fitted in the fluid passage 26 (refer to FIG. 3).

The communication passage 14 is the cavity inside the frame body-like main body 11. The fluid flowing in the fluid passage 26 (refer to FIG. 3) passes through the inside of this communication passage 14. It is desirable that a diameter of the communication passage 14 be 80% or more of the diameter of the main body 11. By a large portion of volume of the main body 11 being the communication passage 14, the main body 11 becomes of a frame body shape.

The projections 15 are arranged radially in a protruding manner toward a central part of the communication passage 14 from an inner peripheral part, and extend along the communication passage 14. Here, "along the communication passage 14" means that it runs along a direction that connects the inflow port 12 and the outflow port 13. The projections 15 are arranged on the upstream side (the inflow port 12 side) to the communication passage 14 of the main body 11. The outflow port 13 side of the main body 11 has a cylindrical part 14*a* on which the projections 15 are not arranged (refer to FIG. 1A).

Regarding the projection 15, it is desirable that it be formed in a V shape whose width becomes thinner gradually toward a direction that goes to the central part of the communication passage 14 from the inner peripheral part when seen from a flow direction of the fluid. In the straightening device 10, the both sides (right and left side faces 15*a*, 15*a* that form a V shape when seen from the flow direction) of the projection 15 are formed with plane surfaces, and extend along the communication passage 14 like a ridge of a plowed field. A bottom of the projection 15 is, over its whole region, in contact with the main body 11. The projection 15 forms a V shape in its cross section (transverse section) in a plane perpendicular to the communication passage 14. A tip of the projection 15 may be sharp, may be rounded, or may be truncated to an approximately trapezoidal shape. Moreover, the side faces 15*a*, 15*a* of the projection 15 that form a V shape may be constituted with curved surfaces instead of the plane surfaces. Such a transverse section of the projection 15 is termed generically a V shape. More preferably, a connection part of the projection 15 and the main body 11 is connected with a gently-sloping curved surface. Thereby, in the case where the straightening device 10 is arranged immediately following a curvilinear part of piping of the fluid passage, it is possible to avoid stress concentration that the projection 15 receives when being suffered to a static pressure or dynamic pressure of the fluid.

The projections 15 are installed so that its number may be two or more, which is set to four in this embodiment as one example. When the projections 15 increases in number, a straightening effect becomes high, but a sectional area of the communication passage 14 becomes small and an effective sectional area reduces. Therefore, it is desirable that the number of the projections 15 be two to six, and three to five are especially desirable. It is desirable that the projections 15 be formed integrally with the main body 11. However, it may be formed separately.

The straightening device 10 is manufactured with a material that has corrosion resistance to the fluid and has a strength corresponding to a pressure to be used such as steels, stainless steels, aluminum alloys, ceramics, and super-hard metals.

The fluid introduced into the inflow port 12 from the feed flow channel (unillustrated) via various fluid passages that are not illustrated passes through the communication passage 14 inside the straightening device 10. Regarding the fluid introduced into the inflow port 12, the flow is turbulent by elbow-shaped bends of the various fluid passages and a variation of the sectional area of the flow channel. The fluid whose flow is made turbulent flows from the inflow port 12 into the communication passage 14 of the straightening device 10, where the projections 15 provided inside the communication passage 14 restrict the flow in a direction perpendicular to a direction along the communication passage 14 to straighten it. Then, the fluid flows into the cylindrical part 14*a*, and is released.

The dynamic pressure of the fluid whose flow is made turbulent and the static pressure of the fluid act on the projections 15 and the main body 11 of the straightening device 10. In the case where the fluid is high-pressure fluid, an impact force called water hammer acts in the fluid at the time of inflow and interception of the fluid. Since the straightening device 10 is comprised of the main body 11 that is a frame body lying along the flow direction and the projections 15 that are installed in a protruding manner from an inner surface of the main body 11, its strength is extremely strong. Since the straightening device 10 has high strength, it is not damaged by the dynamic pressure, the static pressure, and the water hammer by the fluid and its deformation is suppressed.

The communication passage 14 is partitioned by the main body 11 that is the frame body and the projections 15, and its transverse section is extremely wide. Therefore, an effective sectional area of the straightening device 10 becomes larger, pressure loss of the fluid passing through the straightening device 10 is suppressed to be low, and it can make fluid of a large flow rate circulate.

By the transverse section of the projection 15 forming the V shape, the stress that acts on the inside of the projection 15 becomes small, and the strength of the projection 15 improves even when the projection 15 receives compressive stress by the pressure of the fluid passing through the communication passage 14. Then, since the projections are not deformed easily, the straightening effect of the straightening device 10 is maintained high. Since the straightening device 10 of this embodiment has the above-mentioned action effect, it is a straightening device especially suitable for straightening of high-pressure liquid.

In the straightening device 10 according to the embodiment of the present invention, since the projections 15 are of the V shape and the tip part (the central part side of the communication passage 14) of the projection 15 is made thinner than the base end part (inner peripheral part side of the communication passage 14), a cross section length in a circumferential direction from the central part of the straightening device 10 to the peripheral part of the communication passage 14 (indicating a vicinity of an outer peripheral fringe of the communication passage 14) does not vary largely. For this reason, a flow velocity in a radial direction from the central part of the straightening device 10 up to the peripheral part of the communication passage 14 (from the central part to the peripheral part) is kept almost constant. Since the flow velocity in the straightening device 10 is uniform, turbulence of a flow of the fluid passing through the straightening device 10 becomes less, and the straightening device 10 exhibits an excellent straightening effect and reduces the pressure loss.

An application example of a case where the straightening device 10 of this embodiment is embedded in the fluid nozzle 20 will be explained according to FIG. 3. The fluid nozzle 20 is provided with a nozzle main body 21 and a fluid passage 26 in its inside and the straightening device 10 is inserted and fitted into the fluid passage 26. The fluid passage 26 has a restriction 27, and the restriction 27 opens to the outside of the nozzle main body 21. The aperture forms a spouting port 28.

The fluid passage 26 is arranged coaxially with the spouting port 28 of the nozzle main body 21. The fluid passage 26 communicates with the restriction 27 by means of a conic surface 26*a*. The main body 11 of the straightening device 10 is inserted and fitted into the fluid passage 26. Therefore, an axial center of the communication passage 14 provided inside the main body 11 and an axial center of the restriction 27 agree with each other with high precision, and the fluid is introduced into the restriction 27 from the fluid passage 26 through the conic surface 26*a*, forming vena contracta, without occurrence of turbulence in the fluid passing through the straightening device 10. The fluid is spouted from the spouting port 28. Since the straightened fluid spouts from the spouting port 28, a jet flow J with less turbulence (refer to FIG. 5) can be obtained.

The projections 15 are arranged on the upstream side (inflow port 12 side) of the main body 11, and the cylindrical part 14*a* (refer to FIG. 1B) that does not have the projections 15 is arranged on the downstream side (outflow port 13 side) of the main body 11. In the downstream of this cylindrical part 14*a*, the conic surface 26*a* is arranged after passing through the fluid passage 26, and the conic surface 26*a* and the restriction 27 communicate with each other.

In the case where the projections 15 are adjacent to the conic surface 26*a* that communicates with the restriction 27, the flow channel of the fluid temporarily expands rapidly with passing through the projection 15 part, and contracts rapidly again at the restriction 27. For this reason, flow lines deviate from surfaces of the projections 15 in a downstream end of the projections 15. Then, the fluid flows into the restriction 27 while a variation among flow velocities on the circumference caused by the projections 15 remains to exist.

In the fluid nozzle 20, since the cylindrical part 14*a* comprised of a cylindrical surface whose diameter is the same as that of the communication passage 14 of the main body 11 exists between the projections 15 and the restriction 27, high-pressure water having passed by the projections 15 is temporarily released in the cylinder and its flow velocities on the same circumference are uniformized. For this reason, the fluid having passed through the straightening device 10 of this embodiment flows into the restriction 27 at a uniform velocity on the circumference. Therefore, the jet flow J spouted from the restriction 27 has less turbulence, and its straightness is high.

Incidentally, although the projections 15 were arranged on the upstream side of the main body 11 in this embodiment, the projections 15 may be arranged on the downstream side of the main body 11 or along the entire length of the main body 11 depending on a shape of the fluid passage 26.

[Strength]

Figure 4:
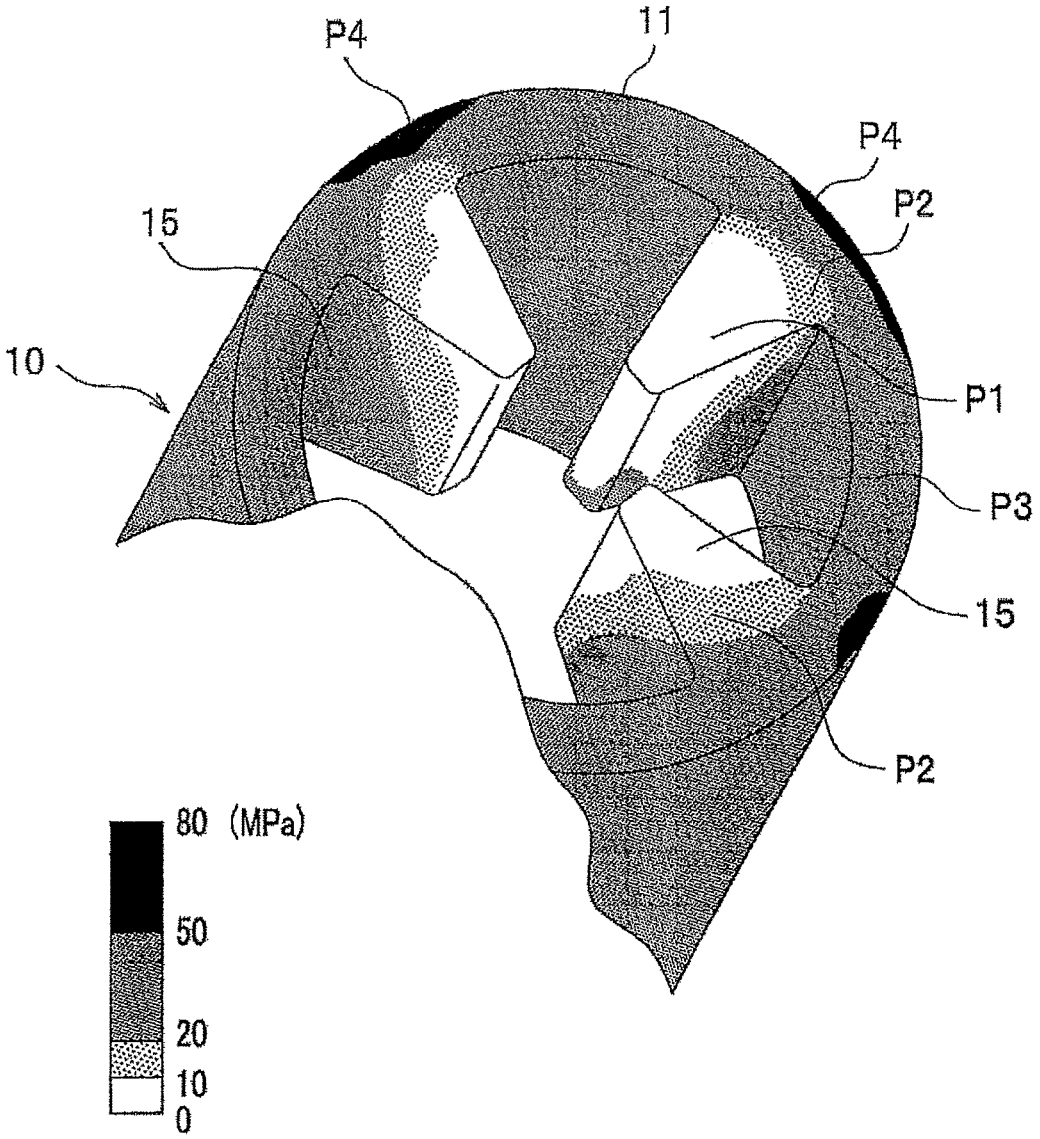
FIG. 4 is a partially cutaway view to show a stress contour diagram when high-pressure fluid flows into the straightening device of the first embodiment of the present invention.

Strength calculation is performed on the straightening device 10 in which the main body 11 that is a frame body of a cylindrical shape (of an outer diameter of 5 mm, an inner diameter of 4 mm, and a length of 6 mm) and the projections 15 of a V shape (of a height of 1.4 mm) each having a straightening action are molded integrally in the straightening device 10 of this embodiment. FIG. 4 is a stress contour diagram obtained as a result of a simulation on assumption of the case where an outer peripheral surface of the straightening device 10 is completely fixed and an internal pressure of 50 MPa acts on the inside of the straightening device. A portion where the stress concentrates most is an end part (edge part) of an outer peripheral part of the main body 11 (refer to page 4), where maximum von Mises stress is also as small as 71 MPa. Since the stress that occurs by the internal pressure acts on the main body 11 of a cylindrical shape, it exerts a small influence on the projection 15 and a variation of the straightening effect becomes small even when the dynamic pressure acts. The stress is strongest, 50 to 71 MPa, at the end (edge part) of the outer peripheral part of the main body 11 (refer to page 4). The stress of the main body 11 of a cylindrical shape is next strongest, and exhibits 20 to 50 MPa (refer to page 3). In the base end part of the projection 15, the stress is 10 to 20 MPa (refer to page 2). The stress of the projection 15 is smallest, exhibiting 0 to 10 MPa (refer to page 1).

Thus, it is possible for the straightening device 10 according to the first embodiment of the present invention to improve the rigidity of the main body 11 and the projections 15 and to acquire the excellent straightening effect by the straightening device 10 being provided with the projections 15 of the V shape that are installed in a protruding manner integrally to the main body 11.

[Structure of Flow of Jet Flow]

Figure 5:
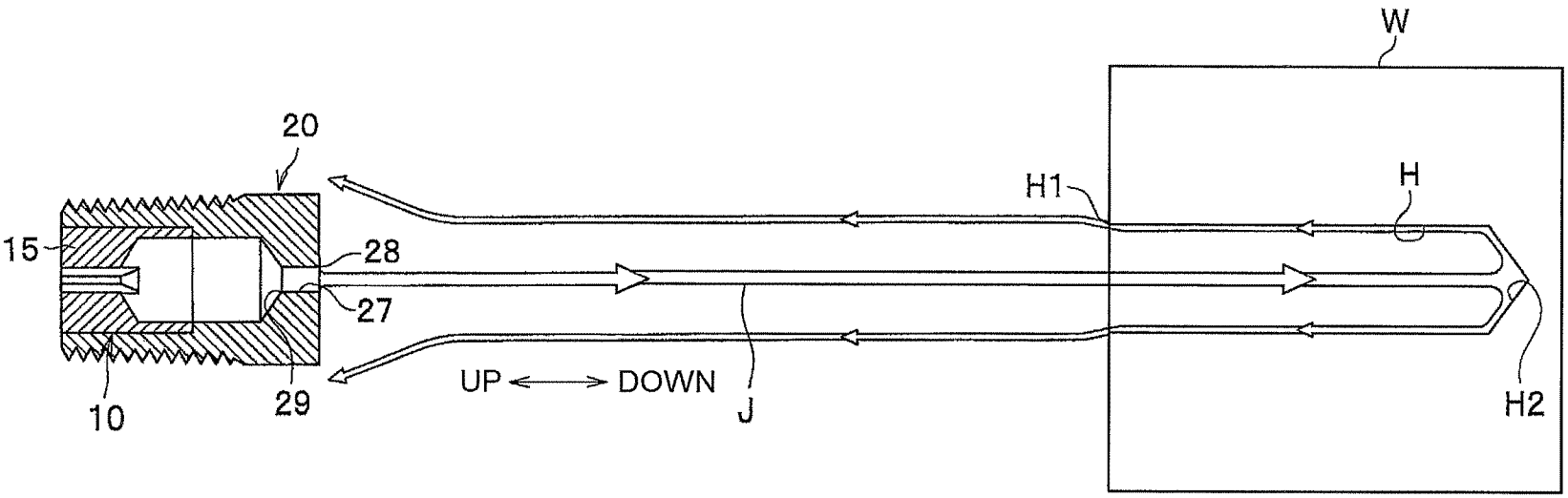
FIG. 5 is a front sectional view showing a flow of a jet flow at the time of making a fluid spout from the fluid nozzle provided with a straightening device of the first embodiment of the present invention.

According to FIG. 5 to FIG. 9, a structure of a flow of the jet flow J that spouted from the fluid nozzle 20 provided with the straightening device of this embodiment into air will be explained. FIG. 5 that is referred to is a schematic front view showing a state where scraps are washed away by jetting the jet flow J to a hole H having a bottom formed in a workpiece W. FIG. 6 to FIG. 9, FIG. 10A, FIG. 10B, FIG. 11A, and FIG. 11B are simulation analysis diagrams of FIG. 5. The simulation was performed by computational fluid dynamics, using analysis software "PHOENICS." A situation of the flow is calculated by a finite volume method, and a state of a turbulent flow is calculated using a k-ϵ model. The model of the analysis is assumed that a diameter of the inflow part of the nozzle is 8 mm and a depth thereof is 10 mm, and is used to check a difference between with and without the straightening device 10. High-pressure water jetted from the choke part of a diameter of 1.7 mm of the nozzle flows into the hole H of a diameter of 8 mm and a depth of 20 mm of the workpiece W away therefrom by 60 mm.

As shown in FIG. 5, the jet flow J jetted toward the hole H formed in the workpiece W from the fluid nozzle 20 is introduced from an entrance H1 of the hole H, rebounds at a bottom H2 of the hole H, and is discharged from the entrance H1 of the hole H. Since liquid having rebounded at the bottom H2 of the hole H passes along a wall surface of the hole H, scraps adhering to the inside of the hole H can be washed and removed efficiently.

Figure 6:
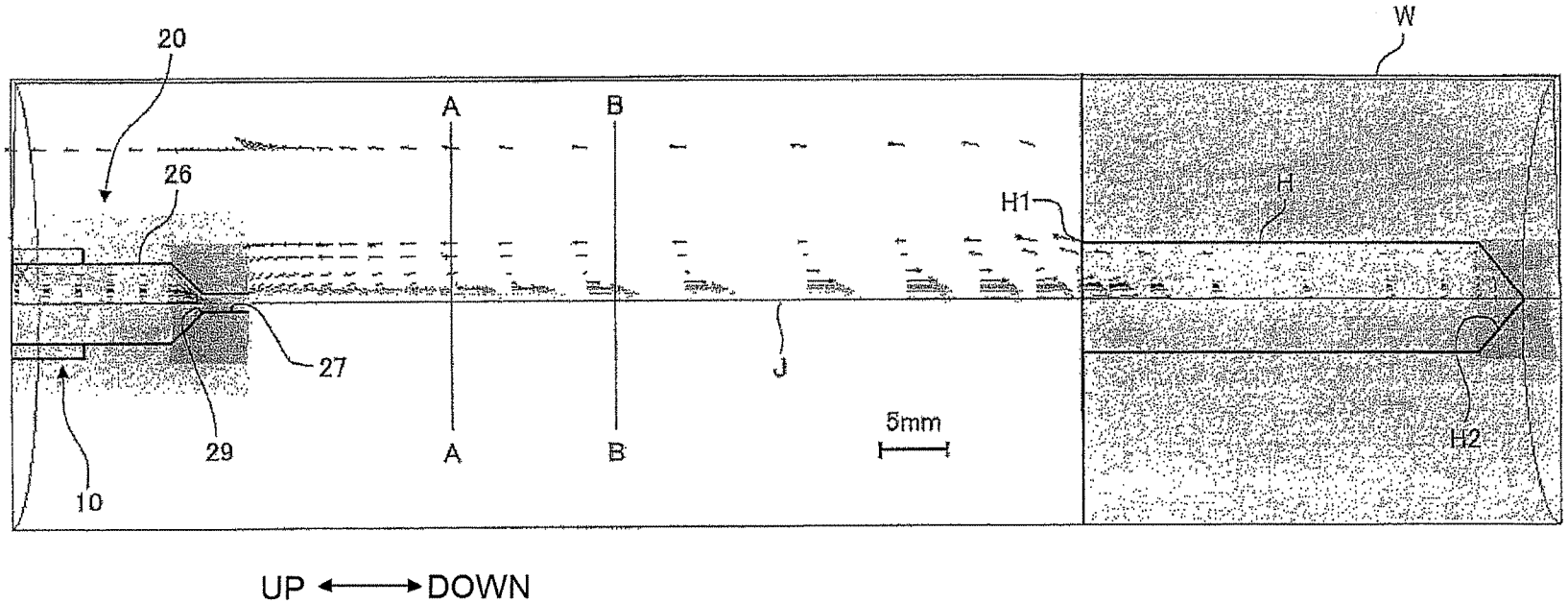
FIG. 6 is a velocity vector diagram of the jet flow when the fluid is made to spout from the fluid nozzle provided with the straightening device of the first embodiment of the present invention.
Figure 7:
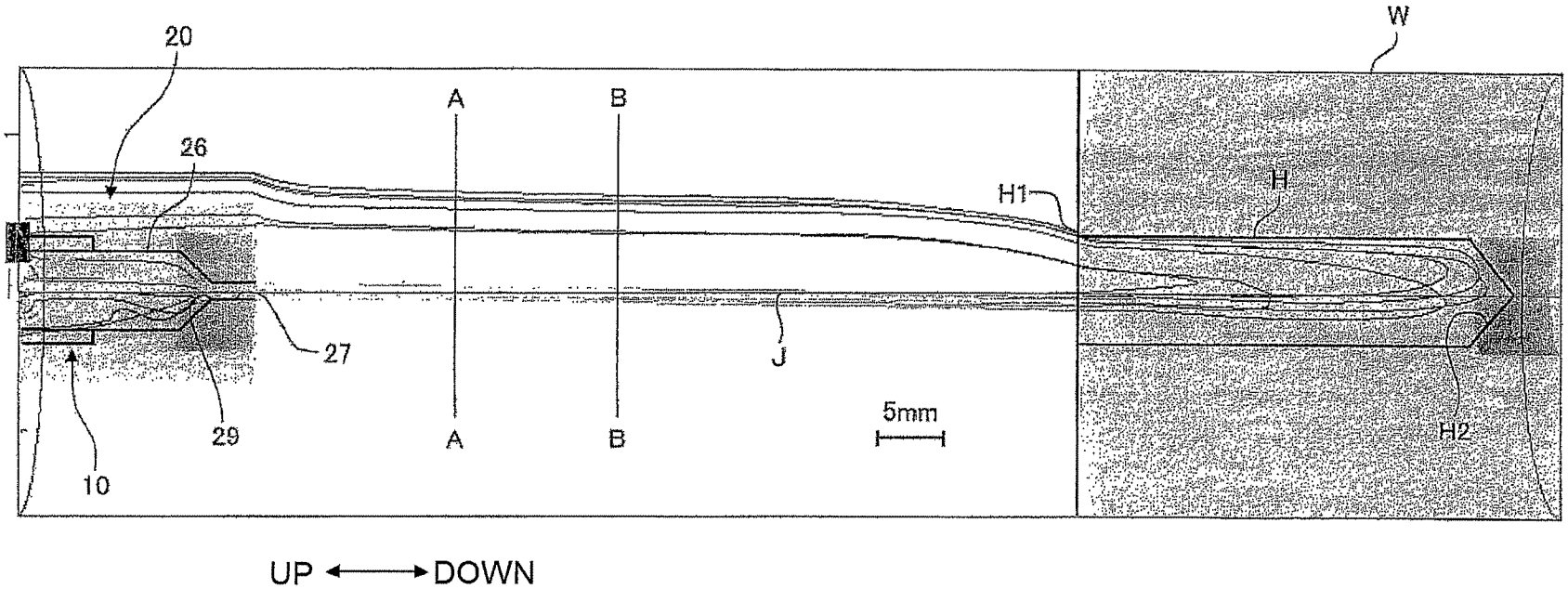
FIG. 7 is a flow line diagram in the jet flow when the fluid is made to spout from the fluid nozzle provided with the straightening device of the first embodiment of the present invention.

FIG. 6 and FIG. 7 show a simulation result of the jet flow J that spouted from the straightening device-attached nozzle made by inserting the straightening device 10 of this embodiment into the fluid nozzle 20. FIG. 6 is a velocity vector diagram. Color tones (tones) of the velocity vectors express velocity ranges. Since the calculation result has converged, the result can be regarded as appropriate. Within the fluid passage 26, in the radial direction, an almost homogeneous velocity distribution is shown toward the cylindrical part 14*a* from the projection 15. Contraction takes place in the vicinity of a nozzle entrance 29, and a velocity in the radial direction arises. Regarding vectors indicating 220 m/s in the jet flow J, a width of them is narrow in a cross section A close to the restriction 27, and the vectors have homogeneous velocities over the entire width of the jet flow J in the radial direction. A cross section B at an intermediate position between the restriction 27 and the workpiece W shows a velocity distribution of a sine curve in which the velocity is as fast as 210 m/s in the central part in the radial direction and is 100 m/s in the peripheral part. The velocity vector of the upward flow that has rebounded by the hole H hardly appears immediately outside the jet flow J. It is understood that the jet flow J is hardly affected by an influence of the high-pressure water that is rebounded by the hole H. At the entrance H1 of the hole H of the workpiece W, the velocity shows 150 m/s in a central part of the jet flow J.

FIG. 7 shows a flow line diagram. The flow lines contract drawing gently-sloping curves from the fluid passage 26 toward the restriction 27, and pass through the restriction 27. After being spouted from the fluid nozzle 20, the flow lines extend almost in parallel toward a surface of the workpiece W, enter the inside of the hole H, and subsequently develop gradually at 180°, and the jet flow is discharged from the surface of the workpiece W along the surface of the hole H. Also when leaving from the workpiece W, the flow lines deviate from a central line gradually, and form the jet flow J again in a thin cylindrical shape as it was in a state where the flow lines are expanded to a width almost the same as an outer diameter of the fluid nozzle 20. That is, the jet flow J is flowing in a center of a cylindrical rebounding flow so as to penetrate it.

As described above, the figure explains a state where the jet flow J enters the hole H while being converged highly, flares out at the bottom H2 and its vicinity, and is discharged in a hollow cylindrical shape along the inner surface of the hole H. As described above, since the jet flow J spouted from the nozzle provided with the straightening device 10 of this embodiment is such that the jet flow J having entered the hole H in the workpiece W does not generate vortexes and is discharged in a cylindrical shape somewhat flaring out along the inner surface of the hole H, an influence that rebound has on the jet flow J is extremely small. Moreover, since rebounded water is discharged without being made turbulent, deposits adhering to the wall surface of the hole H are discharged satisfactorily.

Figure 8:
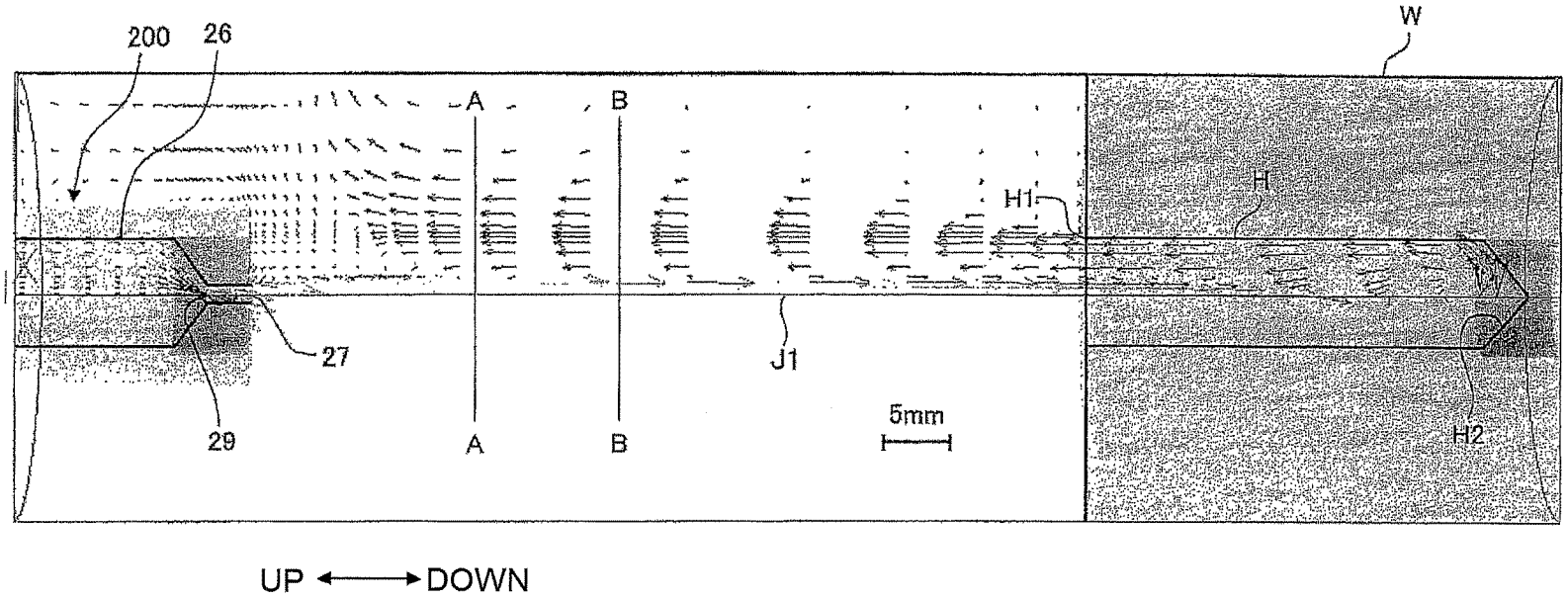
FIG. 8 is a velocity vector diagram of the jet flow when the fluid is made to spout from the fluid nozzle not provided with the straightening device.
Figure 9:
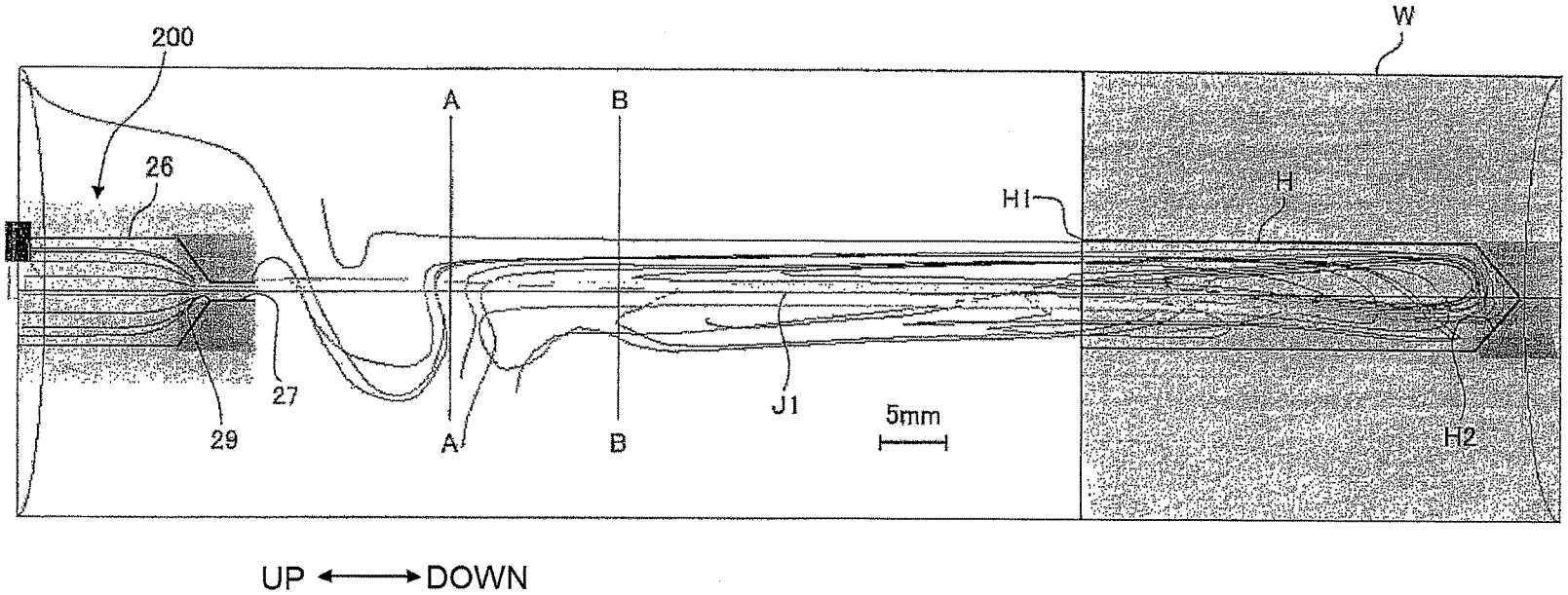
FIG. 9 is a flow line diagram in the jet flow when the fluid is made to spout from the fluid nozzle not provided with the straightening device.
Figure 10B:
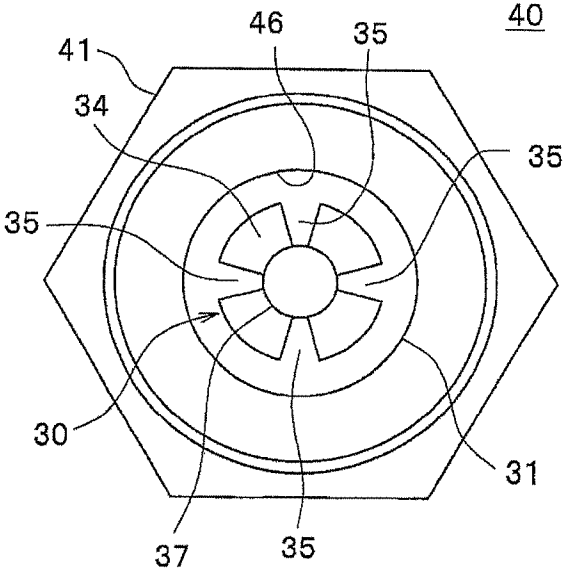
Figure 10A:
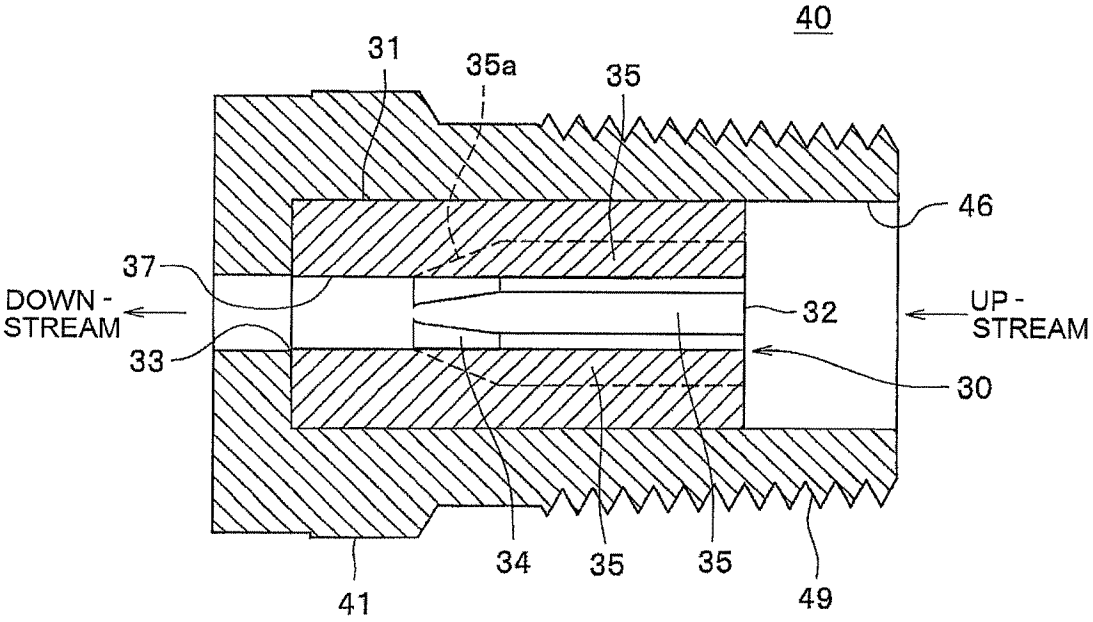
Figure 11B:
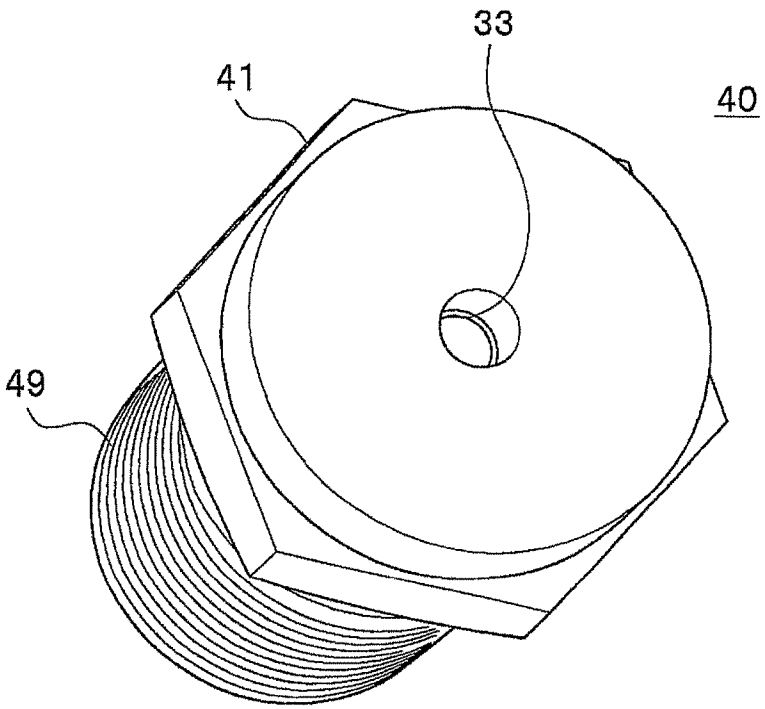
Figure 11A:
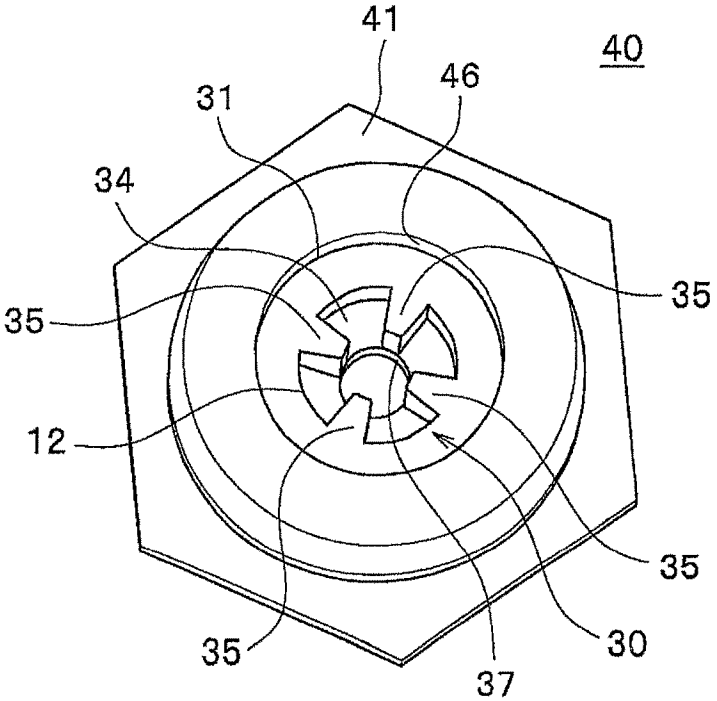

FIG. 8 and FIG. 9 show a result of calculating a flow of a jet flow J1 that spouted into air from a fluid nozzle 200 in which the straightening device 10 (refer to FIG. 1A and FIG. 1B) is not inserted under the above-mentioned condition. FIG. 8 shows a velocity vector diagram. The velocity distribution within the fluid passage 26 is almost uniform. The fluid is tightly reduced in size at the nozzle entrance 29 of the restriction 27, showing a larger velocity in the radial direction than that of the case of using the straightening device 10 of this embodiment. At the cross section A, the velocity distribution is almost uniform over the full width of the jet flow J1, showing about 211 m/s. At the cross section B, the center has the highest velocity in the width of the jet flow J. When a position departs from the center in the radial direction, the velocity decreases drawing a curved line, and outside the jet flow J1, a velocity in the reverse direction arises so as to draw substantially a sine curve. This velocity has reached 110 m/s. Moreover, calculated values tend to diverge around the restriction 27 and generation of vortexes is guessed.

FIG. 9 shows a flow line diagram. The flow lines that spout from the restriction 27 show somewhat broadening. Then, the jet flow J1 that rebounded from the hole H extends toward the hole H again drawing vortexes largely in a section from a position A and its vicinity to the bottom H2 of the hole H. Since the rebounded jet flow J1 becomes vortexes largely and the jet flow J1 involves these, the jet flow J1 is greatly affected by the rebounded liquid flow, which induces attenuation of energy and turbulence of the jet flow J1. The jet flow J1 and the rebounded flow form a field of flow being completely mixed into one.

[Washing Effect]

The fluid nozzle 20 provided with the straightening device 10 of this embodiment was incorporated into a numerical control-type washing apparatus (Spa-Clean Jet (trademark) made by Sugino Machine Limited) of a nozzle movable type, and machine parts are washed in air. A targeted machine part is a transaxle case for automobile. Many screw holes are provided on the surface of the casing. Further, it has multiple deep holes each having a depth about 40 times its hole diameter. The deep holes cross one another to form a complicated shape. A lot of scraps that arose when the casing was subjected to machining are left on the surface of the casing and in the inside of the holes. This washing apparatus moves the fluid nozzle 20 to a position where the restriction of the fluid nozzle 20 faces the hole of such a casing while spouting a high-pressure jet flow from the fluid nozzle 20, and washes the case. Table 1 shows a washing result at this time. A comparative example 1 in Table 1 is a washing result at the time of using the nozzle fluid 200 not provided with the straightening device 10 (refer to FIG. 8 and FIG. 9).

TABLE 1

| Morphology of fluid nozzle | Number of machine parts washed | Number of machine parts with remaining scraps after washing | Number of machine parts with remaining scraps after washing per 1000 machine parts |
|---|---|---|---|
| Present embodiment | 20,000 | 11 | 0.55 |
| Comparative example 1 (without straightening device) | 40,000 | 56 | 1.4 |

When the fluid nozzle 20 provided with the straightening device 10 of this embodiment was used, the number of machine parts with remaining scraps after the washing per the number of machine parts washed of 1000 was 0.55 parts; in the comparative example 1, the number of machine parts with remaining scraps after the washing per the number of machine parts washed of 1000 was 1.40 parts. This straightforwardly indicates that the jet flow J not becoming turbulent is directly connected with washing capability. Since the straightening device 10 of this embodiment is such that its effective sectional area is large and it is provided with a single fluid passage 26, the pressure loss at the time of fluid passing through it is small and a high flow can be passed.

Moreover, since its structure is of high strength, the straightening device 10 is neither deformed nor damaged even in the high-pressure fluid. Since the external surface of the main body 11 is inserted and fitted into the fluid nozzle 20, the fluid nozzle 20 (nozzle main body 21) and the straightening device 10 are assembled precisely; accordingly it can exhibit a high straightening capability. Because of these effects, the jet flow J that spouted from the fluid nozzle 20 provided with the straightening device 10 of this embodiment advances into the hole H of the workpiece W in a converged state, flares out along the bottom H2 of the hole H, reverses its flow direction gradually, and is discharged along the inner wall surface of the hole H, which does not disturb the flow of the jet flow J. Then, the jet flow J is utilized for washing without losing its energy, washing performance improves markedly.

[Impact Force of Jet Flow]

When attaching the fluid nozzle 20 provided with the straightening device 10 of this embodiment of a nozzle diameter of 1.7 mm or the fluid nozzle 200 into which the straightening device of a nozzle diameter of 1.7 mm was not inserted to a downward straight pipe, an impact force of the jet flow when the fluid was jetted at a jet pressure of 20 MPa was measured with a pressure receiving surface ϕ20. Table 2 shows a measured result.

TABLE 2

| | Impact force (kgf) Distance between nozzle and pressure receiving surface (mm) | | | |
|---|---|---|---|---|
| | 20 | 100 | 200 | 300 |
| Present embodiment | 8.5 | 8.0 | 7.5 | 6.5 |
| Comparative example 1 (without straightening device) | 9.0 | 8.0 | 5.2 | 3.5 |

The impact forces of the both did not show a large difference when a distance between the nozzle and the pressure receiving surface was within 100 mm. However, when the distance exceeded 100 mm, the impact force of the comparative example 1 became smaller as the distance became longer, and declined to 3.5 kgf that was a half of 20 mm when the distance was 300 mm. A degradation amount of the fluid nozzle 20 provided with the straightening device 10 of this embodiment was remarkably small compared with the comparative example 1; the impact force lowered only by 23% even in a distance of 300 mm.

The impact force of the jet flow was measured with the pressure receiving surface ϕ20 when the fluid was jetted at a jet pressure of 20 MPa in the case where either the fluid nozzle 20 of a nozzle diameter of 2.0 mm provided with the straightening device 10 of this embodiment or the fluid nozzle 200 of a nozzle diameter of 1.7 mm with no straightening device inserted thereinto was attached horizontally to a tip of a vertically downward flow channel. Table 3 shows a measured result. Here, although two comparative examples differ in nozzle diameter, the flow rates of the jet flows are identical.

TABLE 3

| | Impact force (kgf) Distance between nozzle and pressure receiving surface (mm) | | | |
|---|---|---|---|---|
| | 20 | 100 | 200 | 300 |
| Present embodiment | 8.5 | 8.0 | 7.7 | 7.0 |
| Comparative example 1 (without straightening device) | 7.8 | 7.2 | 5.2 | 3.0 |

With the fluid nozzle 20 of this embodiment, when the distance was 20 mm, the impact force was 8.5 kgf; also when the distance was 300 mm, the impact force was 7.0 kgf. Its degradation amount was only 17%. However, in the comparative example 1, when the distance was 20 mm, the impact force was 7.8 kgf; when the distance was 300 mm, the impact force was 3.0 kgf. The degradation amount reached 61%. In the case where the straightening device 10 of this embodiment is provided, the impact force with respect to the distance did not change largely in the following two cases: when the nozzle was attached coaxially with the flow channel direction (Table 2); and when the nozzle is attached perpendicularly to the flow channel direction (Table 3). This demonstrates that the straightening device 10 of this embodiment has a high straightening function.

Second Embodiment

A fluid nozzle 40 provided with a straightening device 30 of a second embodiment of the present invention will be explained according to FIG. 10A, FIG. 10B, FIG. 11A, and FIG. 11B. The fluid nozzle 40 is comprised of a nozzle main body 41 provided with a fluid passage 46 in its inside and the straightening device 30 that is inserted and fitted into the fluid passage 46 and is provided with a communication passage 34 including a restriction 37.

The nozzle main body 41 has a threaded portion 49 for fixing the nozzle to the upstream side of the outer peripheral part, and forms a substantially cylindrical shape. The nozzle main body 41 is provided with the fluid passage 46 that is a stepped through hole whose diameter on the upstream side is large in its inside. The nozzle main body 41 is manufactured with a metal such as steel and stainless steel. The straightening device 30 is inserted and fitted into a large-diameter part of the fluid passage 46. A main body 31 of the straightening device 30 is of a cylindrical shape having the communication passage 34 in its inside.

The outflow port of the communication passage 34 is formed to be the restriction 37 of a small diameter. The restriction 37 is an orifice type restriction. A communication passage 34 is fabricated so that about 50% to 70% of the full length thereof may be a cylindrical part whose diameter is large. The cylindrical part and the restriction are connected with a cavity part of a truncated cone shape. That is, the communication passage 34 has a large-diameter cylindrical part starting from an inflow port 32 of a large diameter, reduces in size to achieve vena contracta, and communicates to the restriction 37. An exit of the restriction 37 forms an outflow port 33. This outflow port 33 serves as a spouting port of this nozzle.

In the inside of the large-diameter cylindrical part of the communication passage 34, projections 35 are provided radially so as to extend along the communication passage. A transverse section shape of the projection 35 forms a V shape. Although a tip part shape of the projection 35 may be any shape, it may be formed with the identical cylindrical surface as the restriction 37. On the downstream side of the projection 35, a slope part 35*a* in which the width of the projection 35 becomes smaller gradually and the height thereof becomes lower gradually toward the downstream side of the fluid passage 46 is formed. It is desirable that the tip part of the projection 35 be on the same plane as that of the cylindrical surface of the restriction 37, or be on an outer circumferential side than the cylindrical surface. By a configuration that the projection 35 is located at the same position as that of the cylindrical surface of the restriction 37 or is located on the outer circumferential side of it, the fluid having passed by the projections 35 flows into the restriction 37 uniformly. An effect that a flow velocity of the fluid in the straightening device is uniformized by the transverse sectional shape of the projection 35 being a V shape is the same as the first embodiment.

The straightening device 30 is formed integrally with a material of high hardness such as ceramics, super-hard metals, and hard steels. By the straightening device being formed with a material of high hardness, the restriction 37 and the projection 35 can be prevented from wearing out by the fluid flowing in the inside. By the straightening device 30 being inserted and fitted into the nozzle main body 41, the outflow port 33 that is a nozzle spouting port is assembled with the threaded portion 49 with high precision. The straightening device 30 is adhered with the nozzle main body 41. The straightening device 30 may be fixed to the nozzle main body 41 by being sintered. The straightening device 30 can be fixed to the nozzle main body 41 by shrink fitting or press fitting.

Incidentally, although the nozzle main body and the straightening device are manufactured as discrete components in this embodiment, they can be molded integrally.

Other Examples of Use

In the above embodiments, although the straightening device 10 was disposed in the fluid passage 26 that is upstream of the fluid nozzle 20, the straightening device 10 of the present invention can be utilized generally for a use of straightening fluid. For example, the straightening device 10 of the present invention can be installed upstream of a flowmeter. When using the flowmeters such as an electromagnetic flowmeter, a Coriolis mass flowmeter, a differential pressure flowmeter, a Karman vortex flowmeter, and a supersonic flowmeter, it is required that an amount of turbulence of the fluid flowing into the flowmeter should be small. Therefore, a straight line part of a long distance is needed on the inflow side of the flowmeter. However, in fluid apparatuses such as a washing machine, it is often the case where a complicated mechanism is installed in a narrow space. For this reason, it is difficult to provide the long straight line part. Moreover, in order to provide the long straight line part, the length of piping increases, and a manufacturing cost increases. Then, the straightening device 10 can be arranged upstream of the flowmeter as alternative means of the straight line part.

What is claimed is:

1. A fluid nozzle comprising:

a fluid passage having a small diameter part and a large diameter part arranged in an upstream side of the fluid nozzle;

a straightening device inserted and fitted into the large diameter part, the straightening device having:

a frame-like main body formed in a hollow cylinder shape, the main body having: (i) an inflow port arranged in the fluid passage and configured to allow fluid to flow into the fluid passage, (ii) an outflow port configured to allow the fluid to flow out of the fluid passage, and (iii) a communication passage configured to allow the fluid to flow from the inflow port to the outflow port, an inner of the communication passage being 80% or more of an outer diameter of the main body, and less than 100% of the outer diameter of the main body;

a plurality of projections arranged in a protruding manner toward a central part of the communication passage from an inner peripheral part, the projections extend along the communication passage, the projections being arranged on an inflow port side of the main body with respect to the communication passage, the projections being each formed in a V-shape such that a width of each of the projections becomes narrower toward the central part of the communication passage from the inner peripheral part when seen from a flow direction of the fluid, the projections being configured to separate the fluid through the communication passage; and a cylindrical part formed without the projections, the cylindrical part being arranged in an outflow port side of the main body, an inner diameter of the cylindrical part being same as the inner diameter of the communication passage and an inner diameter of the small diameter part;

a restriction arranged in the downstream side of the fluid passage; and a spouting port arranged in this restriction, wherein:

the spouting port is configured such that the fluid that flows out from the outflow port of the straightening device is spouted from the spouting port through the restriction, and a conic-shaped surface is arranged between the restriction and the small diameter part of the fluid passage, the conic-shaped surface communicates the restriction with the fluid passage.

2. The fluid nozzle according to claim 1, wherein:

a tip part of one projection of the projections is thinner than a base end part of the one projection, both sides of the one projection are formed with a surface having a plane shape, and a connection part that connects the one projection and the main body has a surface that is a gently-sloping curved shape.

3. The fluid nozzle according to claim 1, wherein a height of at least one projection of the projections is 35% of an inner diameter of the main body.

* * * * *